US009998815B2

(12) United States Patent
Huang et al.

(10) Patent No.: US 9,998,815 B2
(45) Date of Patent: Jun. 12, 2018

(54) PORTABLE DEVICE AND METHOD FOR ENTERING POWER-SAVING MODE

(71) Applicant: MediaTek Inc., Hsin-Chu (TW)

(72) Inventors: Jing-Yi Huang, Hsinchu (TW); Kuan-Ta Chen, Hsinchu (TW); Chih-Ping Lin, Zhubei (TW)

(73) Assignee: MEDIATEK INC., Hsin-Chu (TW)

( * ) Notice: Subject to any disclaimer, the term of this patent is extended or adjusted under 35 U.S.C. 154(b) by 39 days.

(21) Appl. No.: 14/878,215

(22) Filed: Oct. 8, 2015

(65) Prior Publication Data

US 2017/0105063 A1 Apr. 13, 2017

(51) Int. Cl.
*H04R 1/10* (2006.01)
*H04R 29/00* (2006.01)

(52) U.S. Cl.
CPC ..... *H04R 1/1041* (2013.01); *H04R 1/1033* (2013.01); *H04R 29/001* (2013.01); *H04R 2460/03* (2013.01); *H04R 2460/15* (2013.01); *H04R 2499/11* (2013.01)

(58) Field of Classification Search
CPC ..... H04R 1/1041; H04R 29/001; H04R 2460/03; H04R 2460/15; H04R 2499/11
See application file for complete search history.

(56) References Cited

U.S. PATENT DOCUMENTS

2004/0196992 A1* 10/2004 Ryan ..... H04R 1/10 381/312
2005/0226446 A1* 10/2005 Luo ..... H04R 25/00 381/312
2015/0312669 A1* 10/2015 Song ..... A61B 5/02438 381/74
2016/0150335 A1* 5/2016 Qutub ..... H04R 29/001 381/59

* cited by examiner

*Primary Examiner* — Andrew L Sniezek
(74) *Attorney, Agent, or Firm* — McClure, Qualey & Rodack, LLP

(57) ABSTRACT

A portable device and a method for entering a power-saving mode are provided. An audio signal is transmitted to an earphone via a cable. At least one electrical characteristic on the cable is sensed to generate at least one sensing signal. The at least one sensing signal is sampled to generate at least one data signal. Whether the earphone is in listening position is determined according to the at least one data signal. When it is determined that the earphone is not in listening position, the portable device enters a power-saving mode.

11 Claims, 6 Drawing Sheets

PORTABLE DEVICE AND METHOD FOR ENTERING POWER-SAVING MODE

BACKGROUND OF THE DISCLOSURE

Field of the Disclosure

The disclosure relates to a portable device, and more particularly, to a portable device which can determine whether an earphone is in a listening position.

Description of the Related Art

Most portable devices, such as smart phones, Tablet PCs, handheld game consoles, are capable of generating audio signals. The audio signals can be passed through to earphones, and then acoustic sounds derived from the audio signals are played via the earphones. In some situations, the user may not put the earphones into the ear canals (that is the earphones are not at the listening positions), and the audio signals are still provided to the earphones, which may cause unnecessary power consumption.

BRIEF SUMMARY OF THE DISCLOSURE

Thus, it is desirable to provide a portable device which can determine the usage of an earphone. When the earphone is not in a listening position, it is determined that the earphone is not in use, and then audio signals are not passed through to the earphone, thereby save power consumption.

An exemplary implementation of a method for entering a power-saving mode is provided. The method comprises steps of transmitting an audio signal to an earphone via a cable; sensing at least one electrical characteristic on the cable to generate at least one sensing signal; sampling the at least one sensing signal to generate at least one data signal; determining whether the earphone is in listening position according to the at least one data signal, and entering a power-saving mode when it is determined that the earphone is not in listening position.

An exemplary implementation of a portable device is provided. The portable device is selectively connected with an earphone via a cable. The portable device comprises an audio signal generation circuit, a sensor, a sampling circuit, and a controller. The audio player provides an audio stream. The audio signal generation circuit is configured to receive the audio stream and generate the audio signal according to the audio stream. The audio signal generation circuit provides a channel to transmit the audio signal to the earphone via the cable. The sensor is configured to sense at least one electrical characteristic on the cable and generate a sensing signal. The sampling circuit samples the sensing signal to generate a data signal. The controller receives the data signal and determines whether the earphone is in a listening position according to the data signal. When the controller determines that the earphone is not in the listening position, the portable device enters a power-saving mode.

A detailed description is given in the following implementations with reference to the accompanying drawings.

BRIEF DESCRIPTION OF THE DRAWINGS

The disclosure can be more fully understood by reading the subsequent detailed description and examples with references made to the accompanying drawings, wherein.

DETAILED DESCRIPTION OF THE DISCLOSURE

The following description is of the best-contemplated mode of carrying out the disclosure. This description is made for the purpose of illustrating the general principles of the disclosure and should not be taken in a limiting sense. The scope of the disclosure is best determined by reference to the appended claims.

Figure 1:
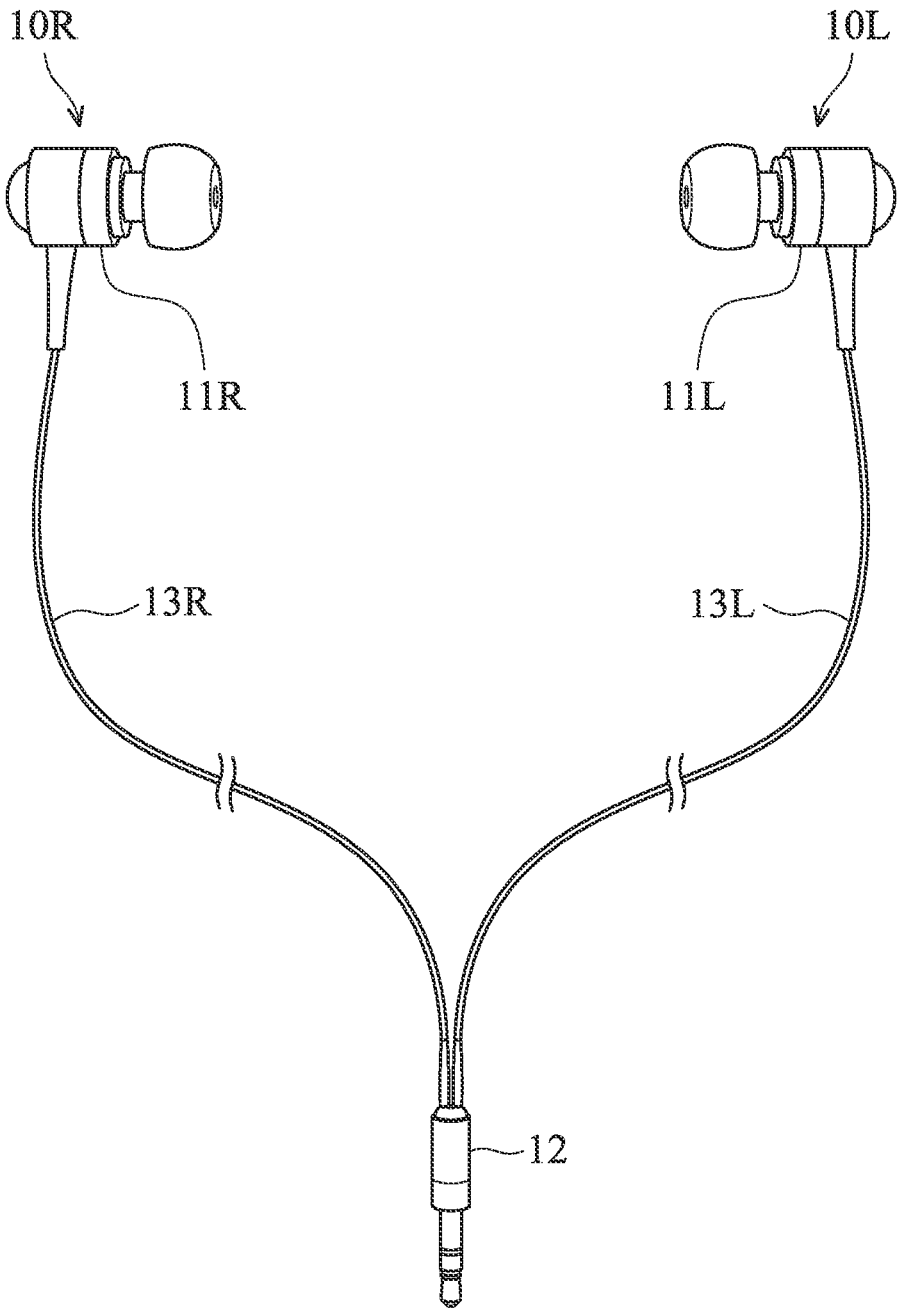
FIG. 1 shows a pair of earphones.

FIG. 1 shows a pair of earphones 10R and 10L. The earphone 10R is applied to play right channel sounds, while the earphone 10L is applied to play left channel sounds. Each of the earphones 10R and 10L has a housing 11. The earphone 10R is given as an example. When the earphone 10R is inserted into the right ear canal of the user (that is when the earphone 10R is in the listening position), there is a resonance cavity formed between the housing 11R and the right ear canal. A lead 13R connected to the earphone 10R and a lead 13L connected to the earphone 10L are connected to a plug. The plug 12 may be inserted into a connection port of an electronic device, such as an electronic device 2 shown in FIG. 2, for receiving audio signals. When each of the earphones 10R and 10L receives a corresponding audio signal, a speaker of the earphone transfers the received audio signal to acoustic sounds and plays the acoustic sounds to the inner ear though the resonance cavity.

Figure 2:
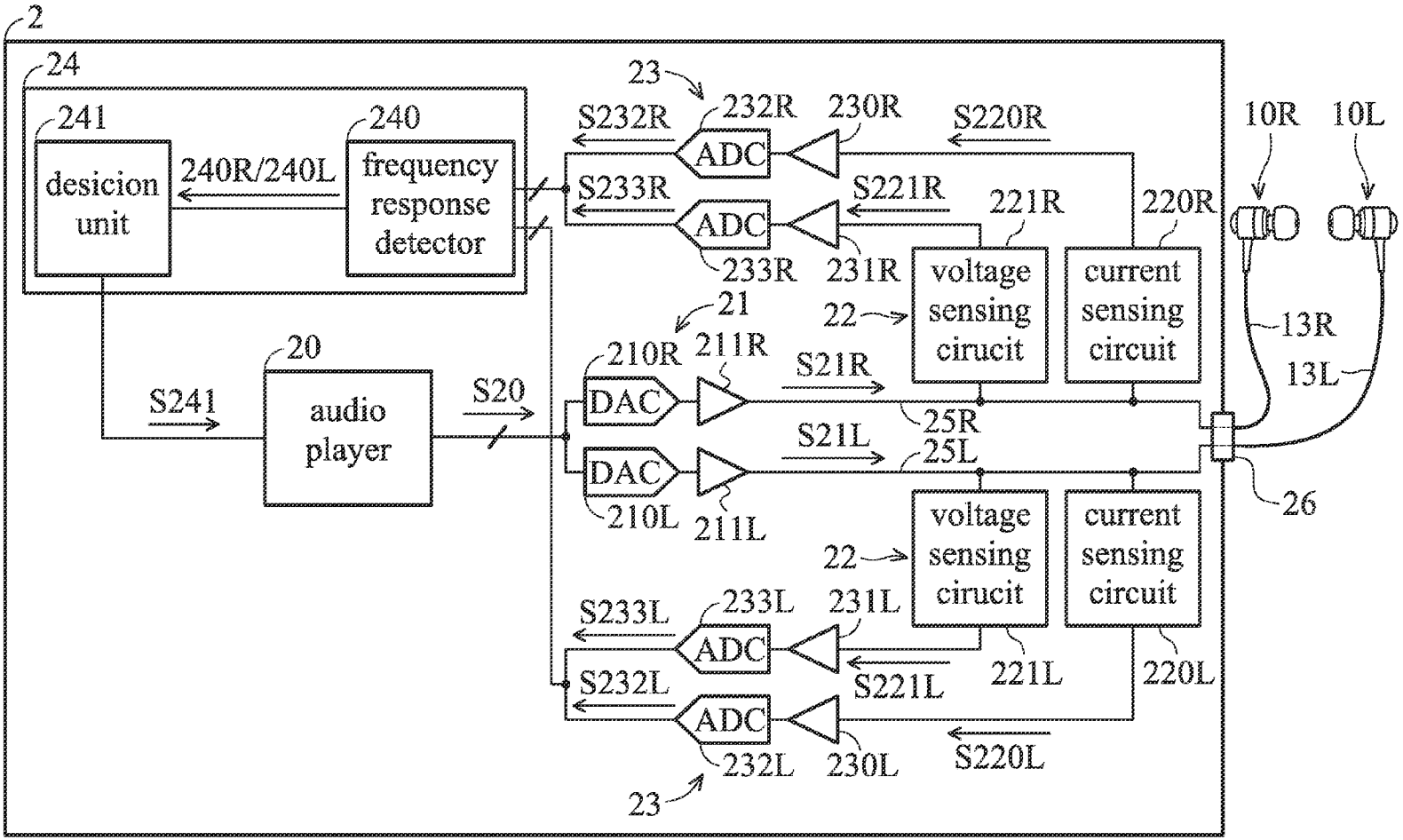
FIG. 2 is a schematic view showing an electronic device connected with a pair of earphones according to one implementation.

Referring to FIG. 2, the earphones 10R and 10L and the electronic device 2 form a portable device, such as a smart phone, a Tablet PC, or a handheld game console. The electronic device 2 comprises an audio player 20, an audio signal generation circuit 21, a sensor 22, a sampling circuit 23, and a controller 24. The electronic device 2 further comprises two cables 25R and 25L and a connection port 26. When the plug 12 (shown in FIG. 1) is inserted into the connection port 26, the cable 25R is in connection with the lead 13R, while the cable 25L is in connection with the lead 13L. In order to show the connection between the cables 25R and 25L and the leads 13R and 13L, the plug 12 is not shown in FIG. 2. The audio signal generation circuit 21 comprises digital-analog converters (DACs) 210R and 210L and amplifiers 211R and 211L. The sensor 22 comprises current sensing circuits 220R and 220L and voltage sensing circuits 221R and 221L. The sampling circuit 23 comprises amplifiers 230R, 231R, 230L and 231L and analog-digital converters 232R, 233R, 232L and 233L. In the following, the operation related to the earphone 10R is taken as an example for illustration. When the audio player 20 is enabled, the audio player 20 provides an audio stream S20 to the audio signal generation circuit 21. The DAC 210R receives the S20 and converters the right channel element on the audio stream S20 to generate an audio signal, and the audio signal is amplified by the amplifier 211R. The amplified audio signal S21R is transmitted to the earphone 10R via the cable 25R and then the lead 13R. In the embodiment, the audio stream S20 is an uncompressed sound signal, and the audio signal S21R is an electronic signal for driving the earphone 10L.

During which the cable 25R carries the amplified audio signal S21R, the current sensing circuit 220R senses the current on the cable 25R and generates a current sensing signal S220R. The amplifier 230R amplifies the current sensing signal S220R, and then the ADC 232R converts the amplified current sensing signal from the amplifier 230R to generate a current data signal S232R. At the same time, the voltage sensing circuit 221R senses the voltage on the cable 25R and generates a voltage sensing signal S221R. The amplifier 231R amplifies the voltage sensing signal S221R, and then the ADC 233R converts the amplified voltage sensing signal from the amplifier 231R to generate a voltage data signal S233R. In the implementation of FIG. 2, the current sensing circuit 220R, the amplifier 230R, and the ADC 232R forms a current sensing path for the earphone 10R, while the voltage sensing circuit 221R, amplifier 231R, and the ADC 233R forms a voltage sensing path for the earphone 10R.

The controller 24 comprises a frequency response detector 240 and a decision unit 241. The frequency response detector 240 receives the current data signal S232R and the voltage data signal S233R and transfers both of the current data signal S232R and the voltage data signal S233R from time domain to frequency domain. The frequency response detector 240 then obtains an impedance frequency response according to the current data signal S232R and the voltage data signal S233R which are in frequency domain and generates an impedance response signal S240R indicating the impedance frequency response. The decision unit 241 obtains the impedance frequency response according to the impedance response signal S240R and compares the feature of the obtained impedance frequency response with the feature of a reference impedance frequency response. As described above, when the earphone 10R is inserted into the right ear canal of the user (that is when the earphone 10R is in the listening position), there is a resonance cavity formed between the housing 11 and the right ear canal. Since the resonance frequency point is shifted due to the formation of the resonance cavity, the obtained impedance frequency response varies with the formation of the resonance cavity, and the feature of the obtained impedance frequency response also varies with the formation of the resonance cavity. Thus, the feature of the obtained impedance frequency response can be used for determining whether the earphone 10R is inserted into the right ear canal of the user (that is whether the earphone 10R is in the listening position).

Figure 3:
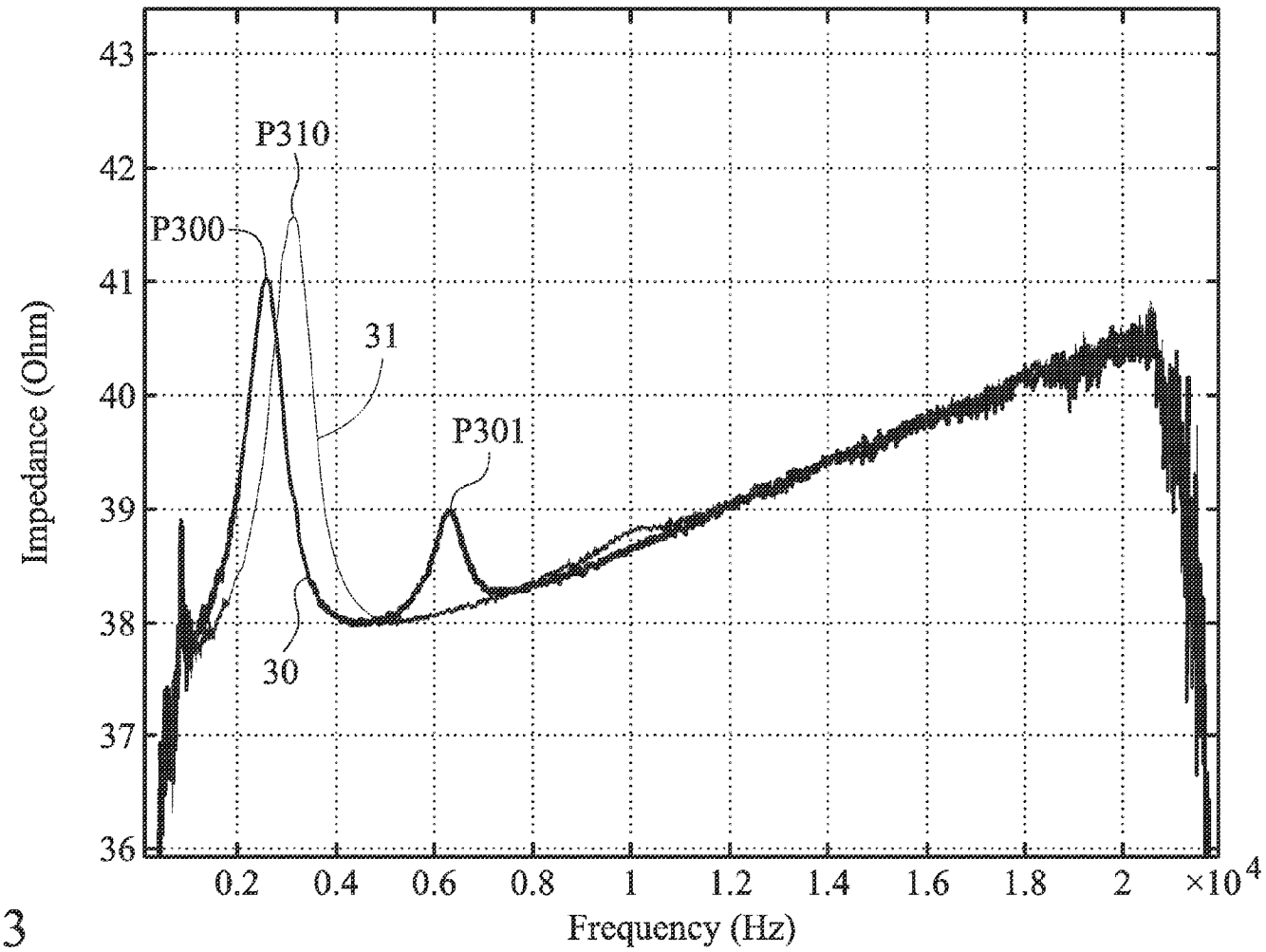
FIG. 3 shows relationship between various frequency values and impedance values, which indicates impedance frequency responses.

Referring to FIG. 3, the relationship between various frequency values on the X axis and corresponding impedance values is used to indicate impedance frequency responses. In FIG. 3, the curves 30 is obtained according to the impedance frequency response derived from the current data signal S232R and the voltage data signal S233R when the earphone 10R is not inserted into the right ear canal of the user (that is when the earphone 10R is not in the listening position). The curve 31 is obtained according to the reference frequency response which is predetermined according to the specification of the earphones 10R and 10L or which is previously derived from the current data signal S232R and the voltage data signal S233R when the earphone 10R is inserted into the right ear canal of the user (that is when the earphone 10R is in the listening position). As shown in FIG. 3, the feature of the curve 30 is different from the feature of the curve 31 due to the change of the resonance cavity formed between the housing 11 and the right ear canal. For example, there are two peaks P300 and P301 at the curve 30 of the obtained impedance frequency response, while there is one peak P310 at the curve 31 of the reference impedance frequency response; the impedance value corresponding to the maximum pick P300 of the curve 30 is different from the impedance value corresponding to the maximum pick P310 of the curve 31; the frequency value corresponding to the maximum pick P300 of the curve 30 is different from the frequency value corresponding to the maximum pick P310 of the curve 31. Thus, the decision unit 241 can determine whether the earphone 10R is inserted into the right ear canal of the user (that is whether the earphone 10R is in the listening position) by comparing the feature of the curve 30 of the obtained impedance frequency response with the feature of the curve 31 of the reference impedance frequency response. In detailed, the decision unit 241 can determine whether the earphone 10R is in the listening position by detecting the number of peaks of the curve 30, the shifting of the impedance value corresponding to the maximum peak P300 of the obtained impedance frequency response 30 by comparing with the reference impedance frequency response, or the frequency value corresponding to the maximum peak P300 of the obtained impedance frequency response by comparing with the reference impedance frequency response.

Similarly, the above operation for determining whether the earphone 10R is in the listening position is also performed for determining whether the earphone 10L is in the listening position. That is, the operations of the DAC 210L, the amplifier 211L, the current sensing circuit 220L, the voltage sensing circuit 221L, the amplifiers 230L and 231L, and the ADCs 232L and 233L are the same as the operations of the DAC 210R, the amplifier 211R, the current sensing circuit 220R, the voltage sensing circuit 221R, the amplifiers 230R and 231R, and the ADCs 232R and 233R. The DAC 210L receives the S20 and converters the left channel element on the audio stream S20 to generate an audio signal S21L, and the audio signal S21L is amplified by the amplifier 211R. The amplified audio signal S21R is transmitted to the earphone 10L via the cable 25L and then the lead 13L, and the audio signal S21L is an electronic signal for driving the earphone 10L.

During which the cable 25L carries the audio signal S21L, the current sensing circuit 220L senses the current on the cable 25L and generates a current sensing signal S220L. The amplifier 230L amplifies the current sensing signal S220L, and then the ADC 232L converts the amplified current sensing signal from the amplifier 230L to generate a current data signal S232L. At the same time, the voltage sensing circuit 221L senses the voltage on the cable 25L and generates a voltage sensing signal S221L. The amplifier 231L amplifies the voltage sensing signal S221L, and then the ADC 233L converts the amplified voltage sensing signal from the amplifier 231L to generate a voltage data signal S233L. In t FIG. 2, the current sensing circuit 220L, amplifier 230L, and the ADC 232L forms a current sensing path for the earphone 10L, while the current sensing circuit 220L, amplifier 231L, and the ADC 233L forms a voltage sensing path for the earphone 10L.

The frequency response detector 240 receives the current data signal S232L and the voltage data signal S233L and transfers both of the current data signal S232L and the voltage data signal S233L from time domain to frequency domain. The frequency response detector 240 then obtains an impedance frequency response according to the current data signal S232L and the voltage data signal S233L in frequency domain and generates an impedance response signal S240L indicating the impedance frequency response. The decision unit 241 obtains the impedance frequency response according to the impedance response signal S240L and compares the feature of the obtained impedance frequency response with the feature of the reference impedance frequency response. In detailed, the decision unit 241 can determine whether the earphone 10L is in the listening position by detecting the number of peaks of the obtained impedance frequency response, the shifting of the impedance value corresponding to the maximum peak of the obtained impedance frequency response by comparing with the maximum peak of the reference impedance frequency response, or the frequency value corresponding to the maximum peak of the obtained impedance frequency response by comparing with the maximum peak of the reference impedance frequency response.

When the decision unit 241 determines that the earphone 10R is not in the listening position and/or that the earphone 10L is not in the listening position, the decision unit 241 generates a disable signal S241 to the audio player 20 for enabling a power-saving mode, and the audio player 20 stops providing the audio stream S20. Thus, the audio signals S21R and S21L are not generated. Accordingly, when the earphones 10R and 10L are not in the respective listening positions, the audio player 20 is disabled, thereby reducing power consumption. In an embodiment, the disable signal S241 is provided to the DACs 210R and 210L. In this case, when the decision unit 241 determines that the earphone 10R is not in the listening position and/or that the earphone 10L is not in the listening position, the audio player 20 still provides the audio stream S20, and, however, the DACs 210R and 210L stop generating the audio signals S21R and S21L respectively. According to the above embodiments, when the decision unit 241 determines that the earphone 10R is not in the listening position and/or that the earphone 10L is not in the listening position, the portable device enters the power-saving mode in which the audio player 20 stops providing the audio stream S20 or the DACs 210R and 210L stop generating the audio signals S21R and S21L respectively.

In an implementation, once the decision unit 241 determines that the earphone 10R is not in the listening position and/or that the earphone 10L is not in the listening position, the decision unit 241 generates the disable signal S241 to the audio player 20 immediately, and the audio player 20 stops providing the audio stream S20 immediately. In another implementation, when the decision unit 241 determines that the earphones 10R and/or 10L are not in the corresponding listening positions continuously for a predetermined time period, the decision unit 241 then generates the disable signal S241 to the audio player 20 immediately, and then the audio player 20 stops providing the audio stream S20.

Figure 4:
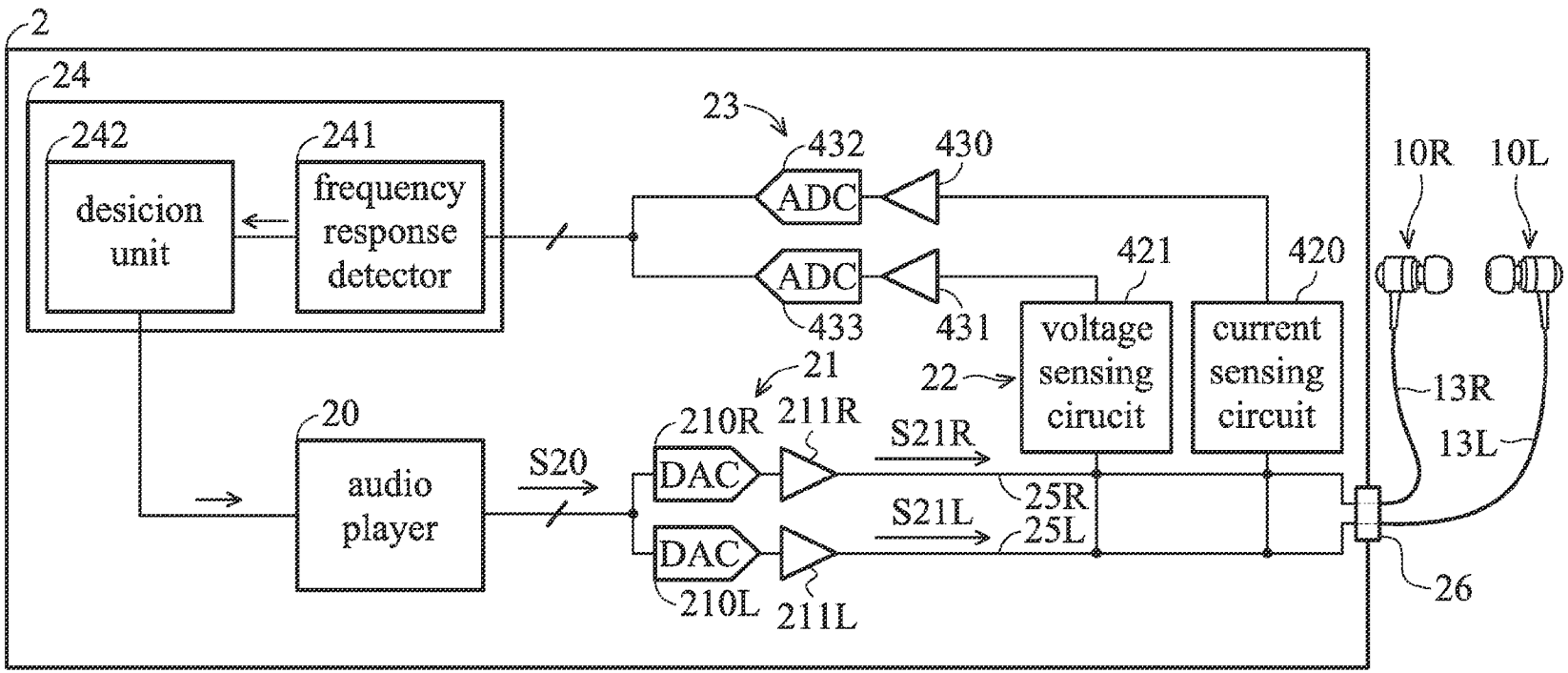
FIG. 4 is a schematic view showing an electronic device connected with a pair of earphones according to another implementation.

In the implementation of FIG. 2, two different current sensing paths and two different voltage sensing paths are applied each for the earphones 10R and 10L. However, in another implementation, the same current sensing path and the same voltage sensing path are applied for both of the earphones 10R and 10L by a time division manner. As shown in FIG. 4, the sensor 22 comprises one current sensing circuit 420 and one voltage sensing circuit 421, and the sampling circuit 23 comprises amplifiers 430 and 431 and ADCs 432 and 433. The operations of the voltage sensing circuit 421, the amplifiers 430 and 431, and the ADCs 432 and 433 are the same as the operations of the corresponding elements shown in FIG. 2, thus, the related description is omitted here. The difference between in FIGS. 2 and 4 is that the elements of the sensor 22 and the sampling circuit 23 shown in FIG. 4 operate in a time division manner for sensing the currents and the voltages on the cables 25R and 25L at different time. By using same current sensing path and voltage sensing path for both earphone 10R and 10L, the number of elements in the sensor 22 and the sampling circuit 23 can be decreased. In an implementation, the sampling circuit 23 of FIG. 4 can be implemented by amplifiers and ADCs in a sound recording path of the electronic device 2.

Figure 5:
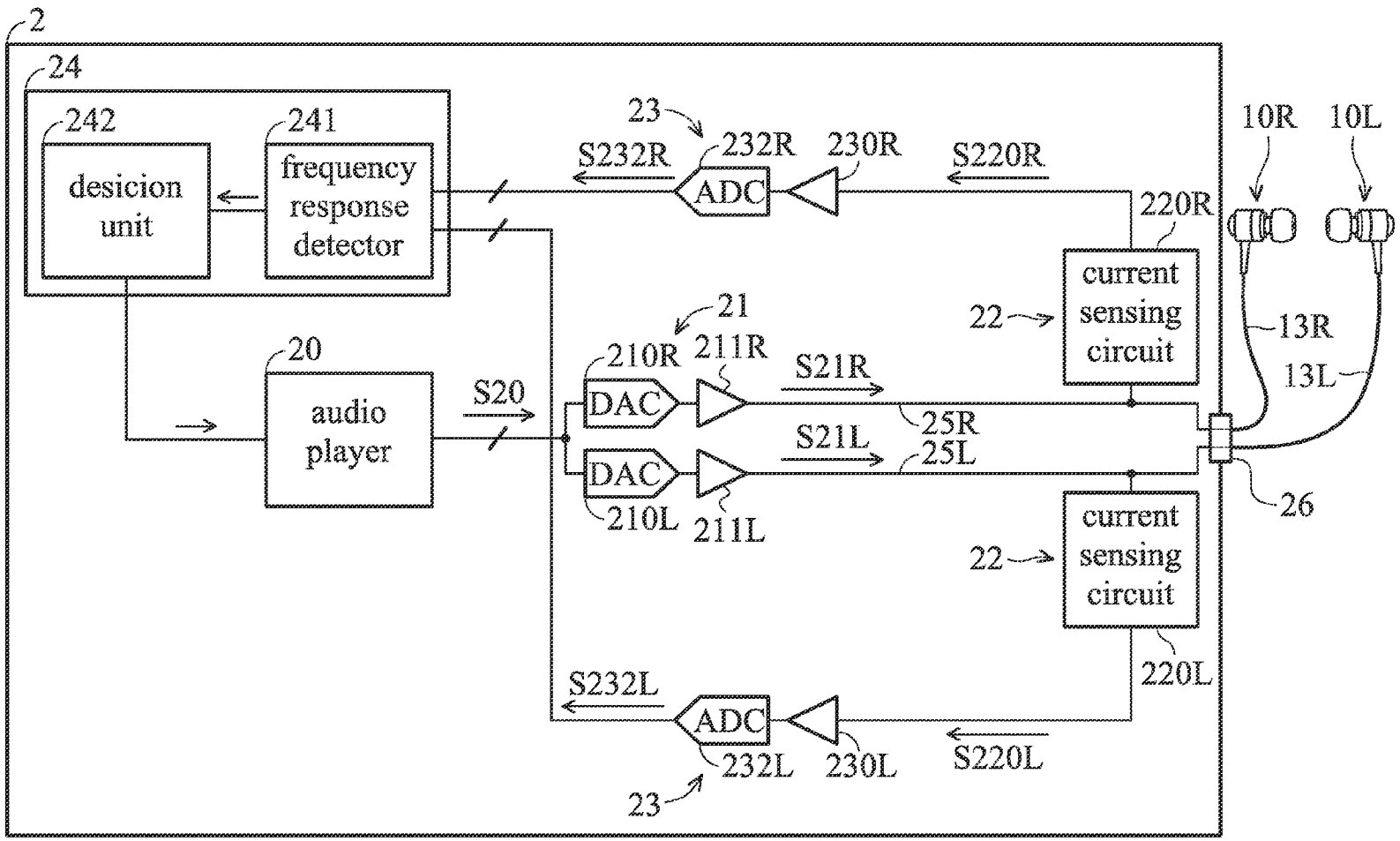
FIG. 5 is a schematic view showing an electronic device connected with a pair of earphones according to another implementation.

In the implementation of FIG. 2, there are one voltage sensing path composed of the voltage sensing circuit 221R, the amplifier 231R, and the ADC 233R for the earphone 10R and one voltage sensing path composed of the voltage sensing circuit 221L, the amplifier 231L, and the ADC 233L for the earphone 10L. In another implementation, as shown in FIG. 5, there are no voltage sensing paths for the earphones 10R and 10L. The frequency response detector 240 can obtain information about the voltages provided to the cables 25R and 25L according to the audio stream S20. Thus, the frequency response detector 240 obtains the impedance frequency response related to the earphone 10R according to the obtained voltage information and the current data signal S232R and obtains the impedance frequency response related to the earphone 10L according to the obtained voltage information and the current data signal S232L.

Figure 6:
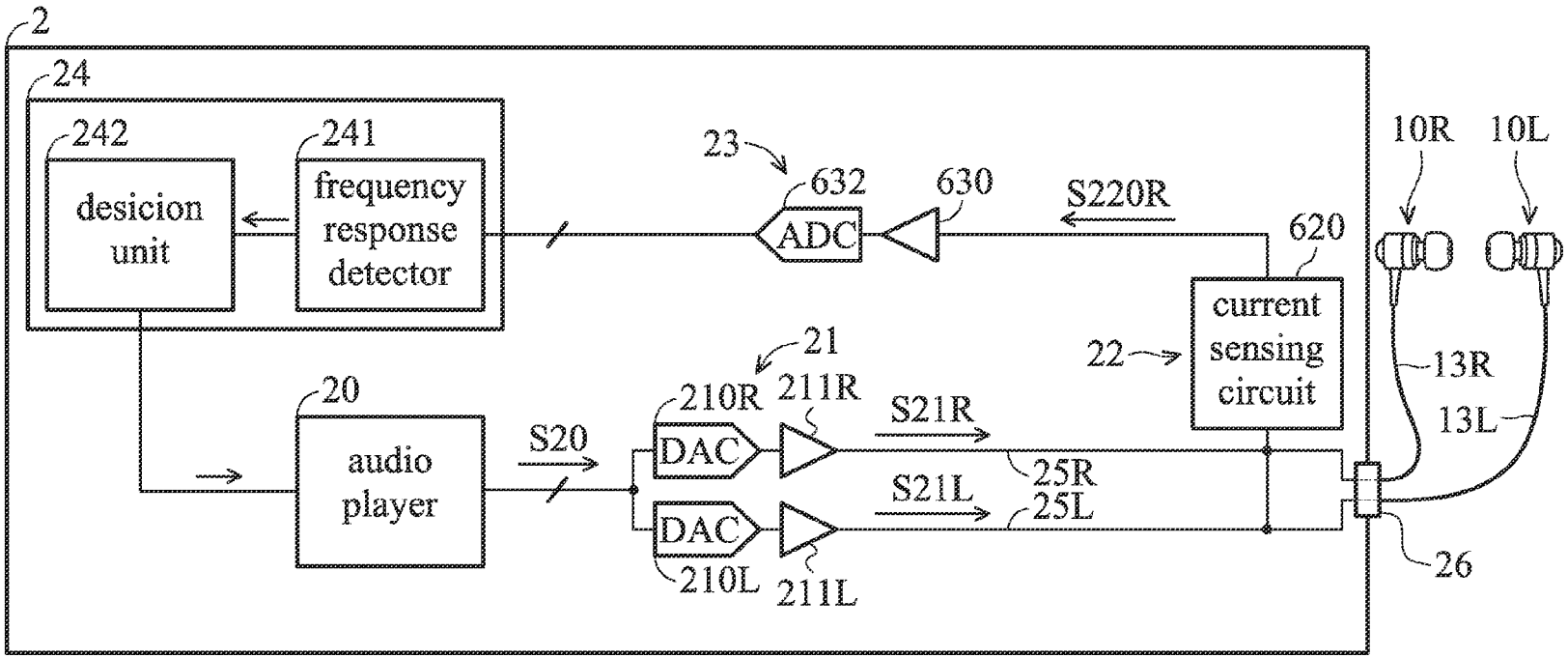
FIG. 6 is a schematic view showing an electronic device connected with a pair of earphones according to another implementation.

In the implementation of FIG. 5, two different current sensing paths are applied for the earphones 10R and 10L. However, in another implementation, the same current sensing path is applied for both of the earphones 10R and 10L by a time division manner. As shown in FIG. 6, the sensor 22 comprises one current sensing circuit 620, and the sampling circuit 23 comprises an amplifier 630 and an ADC 632. The operations of the current sensing circuit 620, the amplifier 630, and the ADC 632 are the same as the operations of the corresponding elements shown in FIG. 2, and, thus, the related description is omitted here. The difference between in FIGS. 5 and 6 is that the elements of the sensor 22 and the sampling circuit 23 shown in FIG. 4 operate in a time division manner for sensing the currents on the cables 25R and 25L at different time. By using one current sensing path for both earphone 10R and 10L, the number of elements in the sensor 22 and the sampling circuit 23 can be decreased. In an implementation, the sampling circuit 23 of FIG. 6 can be implemented by amplifiers and ADCs in a sound recording path of the electronic device 2.

The operations for determining whether the earphones 10L and 10R are in the corresponding listening positions and the operation for providing the audio stream S20 or not according to the determination result may be implemented in computer program, wherein the computer program may be stored in any non-statutory machine-readable storage medium, such as a floppy disc, hard disc, optical disc, or computer program product with any external form. Particularly, when the computer program is loaded and executed by an electronic device, e.g., a computer, the electronic device becomes an apparatus or system for performing the operations for determining whether the earphones 10L and 10R are in the corresponding listening positions and for providing the audio stream S20 or not according to the determination result. Alternatively, the computer program may be transferred via certain transferring media, such as electric wires/cables, optical fibers, or others.

Correspondingly, the invention also proposes a non-statutory machine-readable storage medium comprising a computer program, which, when executed, causes an electronic device to perform the method for generating a mobile APP page template. The operations for determining whether the earphones 10L and 10R are in the corresponding listening positions and for providing the audio stream S20 or not according to the determination result are as described above with respect to FIGS. 2 and 4-6, thus, detailed description of the method is omitted here for brevity.

While the disclosure has been described by way of example and in terms of implementations, it is to be understood that the disclosure is not limited to the disclosed implementations. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for entering a power-saving mode comprising:

generating audio stream by an audio player;

generating an audio signal according to the audio stream by a digital-analog converter;

transmitting the audio signal to an earphone via a cable by the digital-analog converter;

sensing at least one electrical characteristic on the cable to generate at least one sensing signal;

sampling the at least one sensing signal to generate at least one data signal;

determining whether the earphone is inserted into an ear canal of a user according to the at least one data signal; and the digital-analog converter entering a power-saving mode when it is determined that the earphone is not inserted into the ear canal of the user, wherein the step of determining whether the earphone is inserted into the ear canal of the user according to the at least one data signal comprises:

obtaining an impedance frequency response related to the earphone according to the at least one data signal, and determining whether the earphone is inserted into the ear canal of the user according to a number of peaks of the impedance frequency response.

2. The method as claimed in claim 1, wherein the step of sensing the at least one electrical characteristic on the cable to generate the at least one sensing signal comprises:

sensing a current on the cable to generate a current sensing signal, wherein the step of sampling the at least one sensing signal to generate at least one data signal comprises:

sampling the current sensing signal to generate a current data signal, wherein the step of determining whether the earphone is inserted into the ear canal of the user according to the at least one data signal comprises:

determining whether the earphone is inserted into the ear canal of the user according to the current data signal.

3. The method as claimed in claim 2, wherein the step of sensing the at least one electrical characteristic on the cable to generate the at least one sensing signal further comprises:

sensing a voltage on the cable to generate a voltage sensing signal, wherein the step of sampling the at least one sensing signal to generate at least one data signal further comprises:

sampling the voltage sensing signal to generate voltage data signal, wherein the step of determining whether the earphone is inserted into the ear canal of the user according to the current data signal further comprises:

determining whether the earphone is inserted into the ear canal of the user is according to the current data signal and the voltage data signal.

4. The method as claimed in claim 1, wherein the step of determining whether the earphone is inserted into the ear canal of the user according to the at least one data signal further comprises:

comparing the number of peaks of the impedance frequency response with a number of peaks of a reference impedance frequency response; and determining that the earphone is not inserted into the ear canal of the user when the number of peaks of the impedance frequency response is different from the number of peaks of the reference impedance frequency response.

5. The method as claimed in claim 1, wherein the step of the digital-analog converter entering the power-saving mode when it is determined that the earphone is not inserted into the ear canal of the user comprises:

providing to a disable signal to the digital-analog converter; and stopping generating the audio signal by the digital-analog converter according to the disable signal.

6. A portable device selectively connected with an earphone via a cable, the portable device comprising:

an audio player providing an audio stream;

an audio signal generation circuit, configured to receive the audio stream, generate an audio signal according to the audio stream and transmit the audio signal to the earphone via cable, wherein the audio signal generation circuit comprises a digital-analog converter which generates the audio signal according to the audio stream;

a sensor, configured to sense at least one electrical characteristic on the cable and generate a sensing signal;

a sampling circuit sampling the sensing signal to generate a data signal; and a controller receiving the data signal, obtaining an impedance frequency response related to the earphone according to the data signal, and determining whether the earphone is inserted into an ear canal of a user according to a number of peaks of the impedance frequency response, wherein when the controller determines that the earphone is not inserted into the ear canal of the user the digital-analog converter enters a power-saving mode.

7. The portable device as claimed in claim 6, wherein the sensor senses a current on the cable when the cable carries the audio signal and generates a current sensing signal, the sampling circuit samples the current sensing signal to generate a current data signal, and the controller determines whether the earphone is inserted into the ear canal of the user according to the current data signal.

8. The portable device as claimed in claim 7, wherein the sensor further senses a voltage on the cable when the cable carries the audio signal and generates a voltage sensing signal, the sampling circuit further samples the voltage sensing signal to generate a voltage data signal, and the controller determines whether the earphone is inserted into the ear canal of the user according to the current data signal and the voltage data signal.

9. The portable device as claimed in claim 8, wherein the controller comprises:

a frequency response detector transferring both of the current data signal and the voltage data signal from a time domain to a frequency domain and obtaining the impedance frequency response related to the earphone according to the current data signal and the voltage data signal which are in the frequency domain;

a decision unit comparing the number of peaks of the impedance frequency response with a number of peaks of a reference impedance frequency response and determining that the earphone is not inserted into the ear canal of the user when the number of peaks of the impedance frequency response is different from the number of peaks of the reference impedance frequency response.

10. The portable device as claimed in claim 6, wherein the sampling circuit comprises:

an amplifier for receiving and amplifying the sensing signal; and an analog-digital converter, coupled to the amplifier, converting the sensing signal from the amplifier to the data signal.

11. The portable device as claimed in claim 6, wherein when the controller determines that the earphone is inserted into the ear canal of the user, the controller generates a disable signal, and the digital-analog converter stops generating the audio signal according to the disable signal.

* * * * *